US010155646B2

(12) United States Patent
Lee

(10) Patent No.: US 10,155,646 B2
(45) Date of Patent: Dec. 18, 2018

(54) FORKLIFT INCLUDING AN APPARATUS FOR CONTROLLING THE FORKLIFT

(71) Applicant: DOOSAN CORPORATION, Seoul (KR)

(72) Inventor: Jin Yong Lee, Incheon (KR)

(73) Assignee: DOOSAN CORPORATION, Seoul (KR)

( * ) Notice: Subject to any disclaimer, the term of this patent is extended or adjusted under 35 U.S.C. 154(b) by 36 days.

(21) Appl. No.: 15/104,576

(22) PCT Filed: Oct. 6, 2014

(86) PCT No.: PCT/KR2014/009368
§ 371 (c)(1),
(2) Date: Jun. 15, 2016

(87) PCT Pub. No.: WO2015/102209
PCT Pub. Date: Jul. 9, 2015

(65) Prior Publication Data

US 2017/0043988 A1 Feb. 16, 2017

(30) Foreign Application Priority Data

Dec. 30, 2013 (KR) ..... 10-2013-0166860

(51) Int. Cl.
*B66F 17/00* (2006.01)
*B66F 9/12* (2006.01)
(Continued)

(52) U.S. Cl.
CPC ..... *B66F 17/003* (2013.01); *B66F 9/12* (2013.01); *B66F 9/22* (2013.01); *B66F 9/24* (2013.01)

(58) Field of Classification Search
CPC .. B66F 17/003; B66F 9/12; B66F 9/22; B66F 9/24; B66F 9/0755; B60T 7/12
(Continued)

(56) References Cited

U.S. PATENT DOCUMENTS 4,331,417 A * 5/1982 Shearer, Jr. ..... B65G 1/0421 250/223 R
4,491,918 A * 1/1985 Yuki ..... B66F 9/24 414/273
(Continued)

FOREIGN PATENT DOCUMENTS

CN 102730607 A 10/2012
JP H0761792 A 3/1995
(Continued)

OTHER PUBLICATIONS

Office Action issued in corresponding Chinese Patent Application No. 201480071646.7 dated May 2, 2017, consisting of 15 pp. (English Translation Provided).
(Continued)

*Primary Examiner* — Richard A Goldman
(74) *Attorney, Agent, or Firm* — Volpe and Koenig, P.C.

(57) ABSTRACT

The present disclosure relates to an apparatus and a method for controlling a forklift. The apparatus and the method for controlling the forklift according to the present disclosure adjusts a fork/mast inclination by referring to cargo load and forklift speed, and particularly, when a movement direction of a cargo when the cargo slides on a fork in a forward direction, thereby preventing the cargo from falling. Further, when a degree of danger is not decreased even when a fork/mast inclination is tilted backward to the largest extent, the apparatus and the method for controlling the forklift according to the present disclosure may decrease a travelling speed of a vehicle by decreasing an output of the forklift or
(Continued)

operating a brake, thereby remarkably decreasing the danger of the cargo falling.

5 Claims, 5 Drawing Sheets

(51) Int. Cl.
*B66F 9/24* (2006.01)
*B66F 9/22* (2006.01)

(58) Field of Classification Search
USPC ..... 701/50, 124, 42, 49; 187/247
See application file for complete search history.

(56) References Cited

U.S. PATENT DOCUMENTS 4,869,635 A * 9/1989 Krahn ..... B66F 9/063 414/274
5,986,560 A * 11/1999 Rayburn ..... G01G 19/083 177/136
5,995,001 A * 11/1999 Wellman ..... B66F 17/003 340/438
6,050,770 A * 4/2000 Avitan ..... B66F 17/003 187/242
6,056,501 A * 5/2000 Ishikawa ..... B66F 9/0755 187/222
6,092,976 A * 7/2000 Kamiya ..... B66F 9/22 187/223
6,164,415 A * 12/2000 Takeuchi ..... B66F 9/22 187/223
6,256,566 B1 * 7/2001 Kamiya ..... B66F 17/003 172/4.5
6,266,594 B1 * 7/2001 Ishikawa ..... B60G 17/005 177/1
6,267,042 B1 * 7/2001 Nagai ..... F15B 19/00 367/97
6,287,236 B1 * 9/2001 Ishikawa ..... B60T 7/12 192/18 A
6,600,111 B2 * 7/2003 Simons ..... G01G 19/083 177/139
6,611,746 B1 * 8/2003 Nagai ..... B66F 9/0755 187/222
7,568,547 B2 * 8/2009 Yamada ..... B66F 9/07572 180/282
8,965,561 B2 * 2/2015 Jacobus ..... G06Q 10/087 700/214
9,715,232 B1 * 7/2017 Fischer ..... G01S 17/08
2004/0098146 A1 * 5/2004 Katae ..... B66F 9/0755 700/50
2004/0158380 A1 * 8/2004 Farber ..... B66F 17/003 701/50
2004/0226776 A1 * 11/2004 Allerding ..... B66F 9/0755 187/247
2005/0102081 A1 * 5/2005 Patterson ..... B66F 17/003 701/50
2005/0281656 A1 * 12/2005 Bozem ..... B66F 17/003 414/635
2007/0080025 A1 * 4/2007 Yamada ..... B66F 9/07572 187/224
2007/0084450 A1 * 4/2007 Oka ..... B60K 28/08 123/675
2008/0011530 A1 * 1/2008 Oka ..... B60W 10/02 180/306
2009/0101447 A1 * 4/2009 Durham ..... B66F 9/0755 187/238
2009/0174538 A1 7/2009 Shibata
2010/0037700 A1 * 2/2010 Zwygart ..... B66C 1/40 73/800
2010/0063682 A1 * 3/2010 Akaki ..... B66F 17/003 701/42
2010/0145551 A1 * 6/2010 Pulskamp ..... B66F 9/07581 701/2
2010/0238010 A1 * 9/2010 Ishikawa ..... B66F 9/082 340/441
2011/0166721 A1 * 7/2011 Castaneda ..... B62D 15/0265 701/2
2012/0101684 A1 * 4/2012 Takazato ..... B66F 9/07568 701/41
2013/0182237 A1 * 7/2013 Viereck ..... B66F 9/0755 356/3
2014/0071430 A1 * 3/2014 Hansen ..... B66F 9/0755 356/4.01
2014/0277691 A1 * 9/2014 Jacobus ..... G06Q 10/087 700/216
2016/0041028 A1 * 2/2016 Hammerl ..... B66F 9/06 701/50
2016/0376135 A1 * 12/2016 Kim ..... B66F 9/0755 701/50
2017/0043988 A1 * 2/2017 Lee ..... B66F 9/24
2017/0240396 A1 * 8/2017 Oberg ..... B66F 9/0755

FOREIGN PATENT DOCUMENTS

JP 10-316391 A 12/1998
KR 1019970006523 A 4/1997
KR 10-0236442 A 12/1999
KR 1020090069529 A 7/2009
KR 1020120069816 A 6/2012
KR 1020130086746 A 8/2013

OTHER PUBLICATIONS

International Search Report mailed in corresponding International Patent Application No. PCT/KR2014/009368 dated Jan. 8, 2015, consisting of 5 pp. (English Translation Provided).
Written Opinion mailed in corresponding International Patent Application No. PCT/KR2014/009368 dated Jan. 8, 2015, consisting of 8 pp.
Extended European Search Report dated Jul. 31, 2017 in corresponding European Patent Application No. 14 87 6660.3, consisting of 11 pp.

* cited by examiner

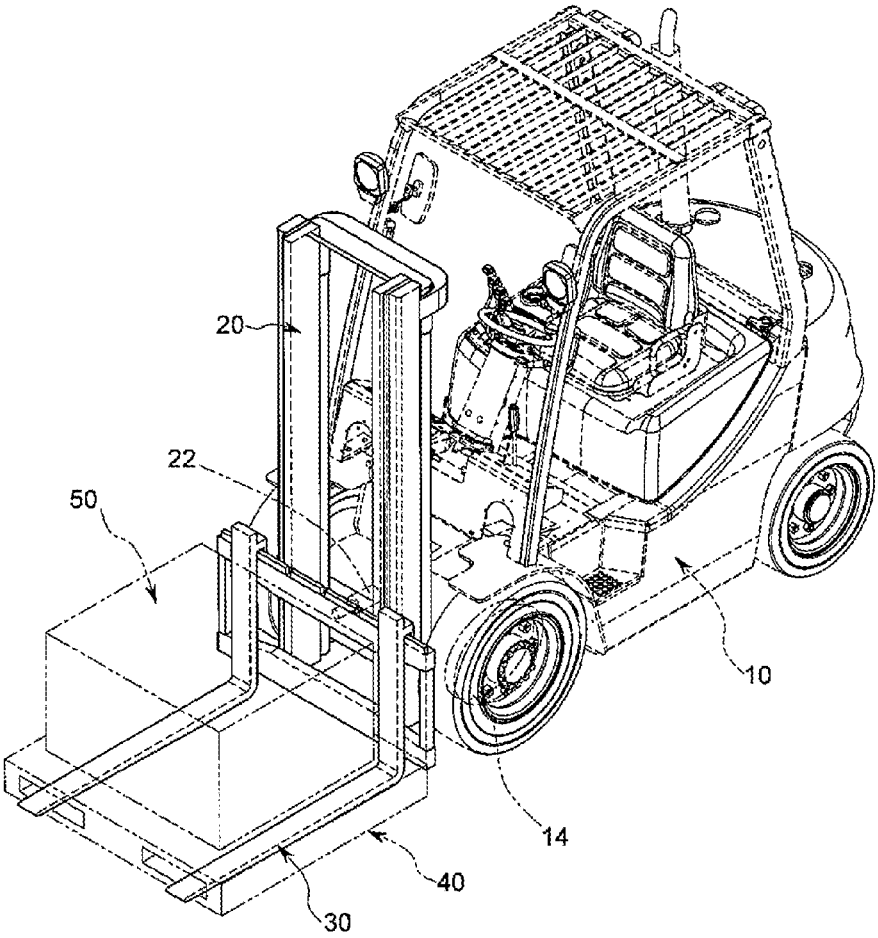
[FIG.1.]

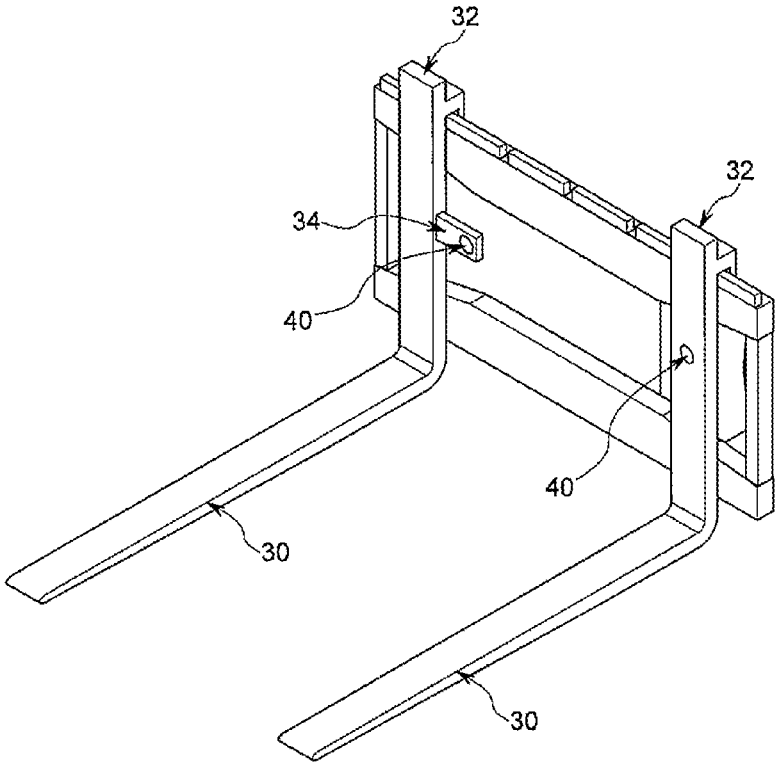
[FIG.2.]

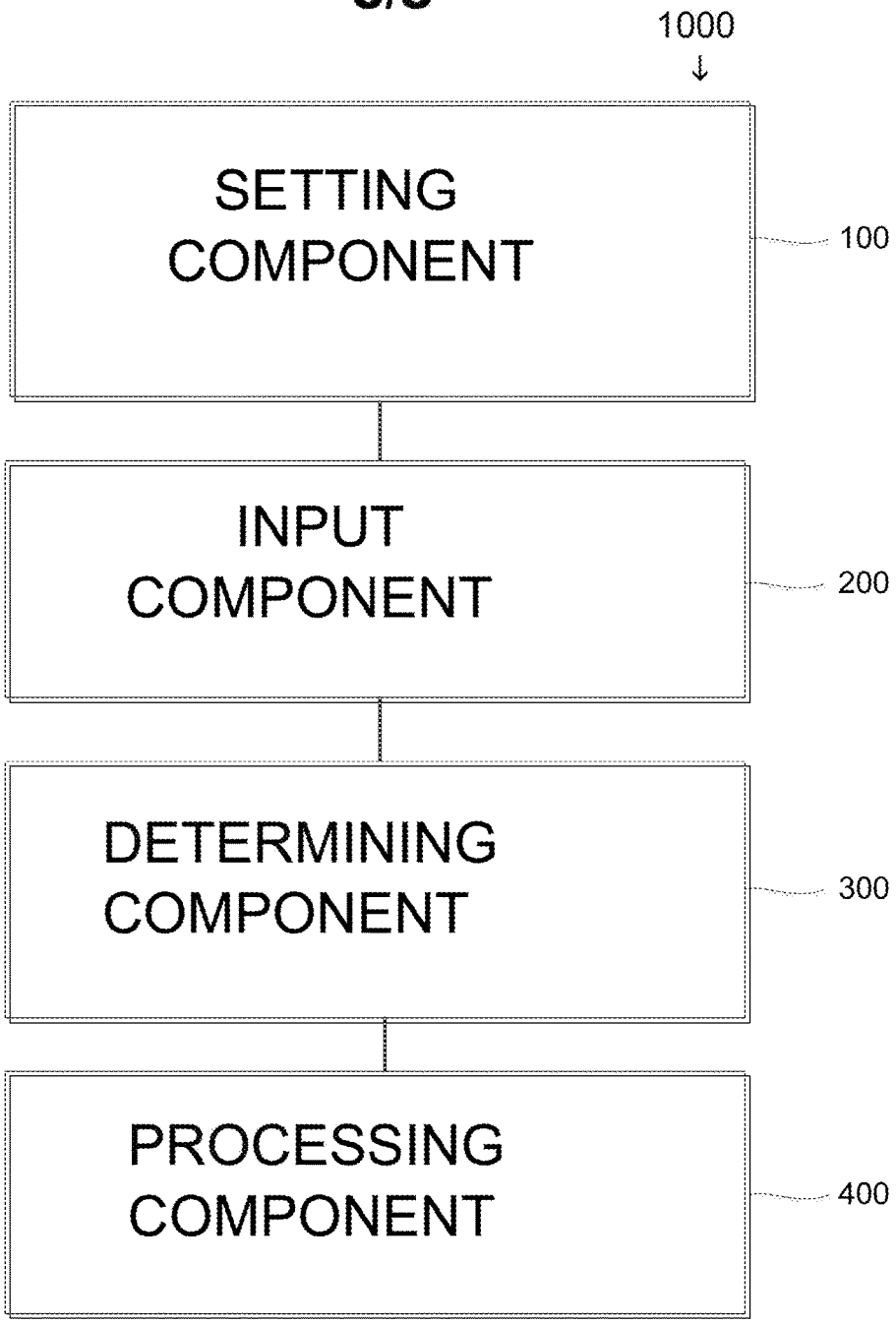
[FIG. 3]

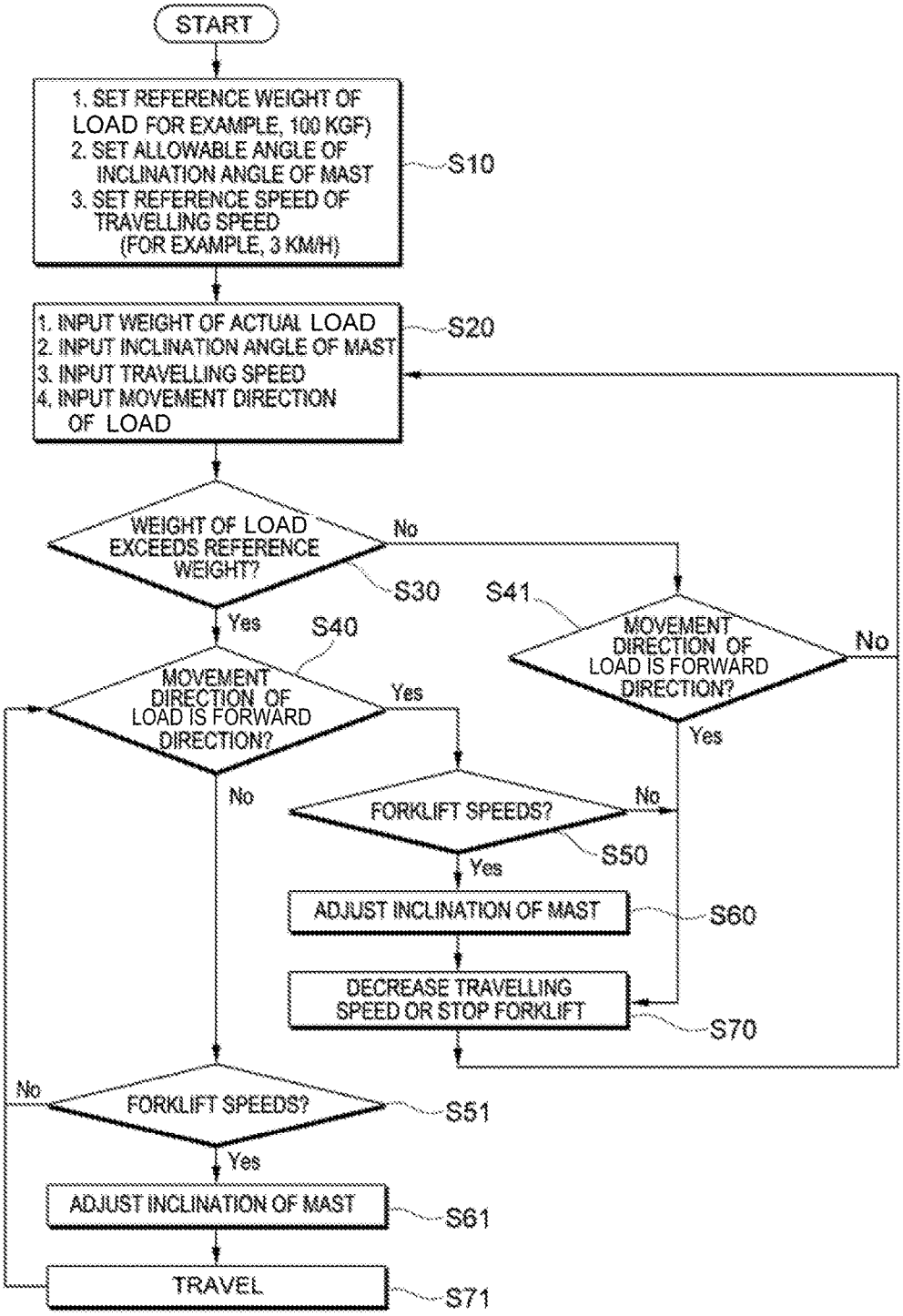
[FIG. 4]

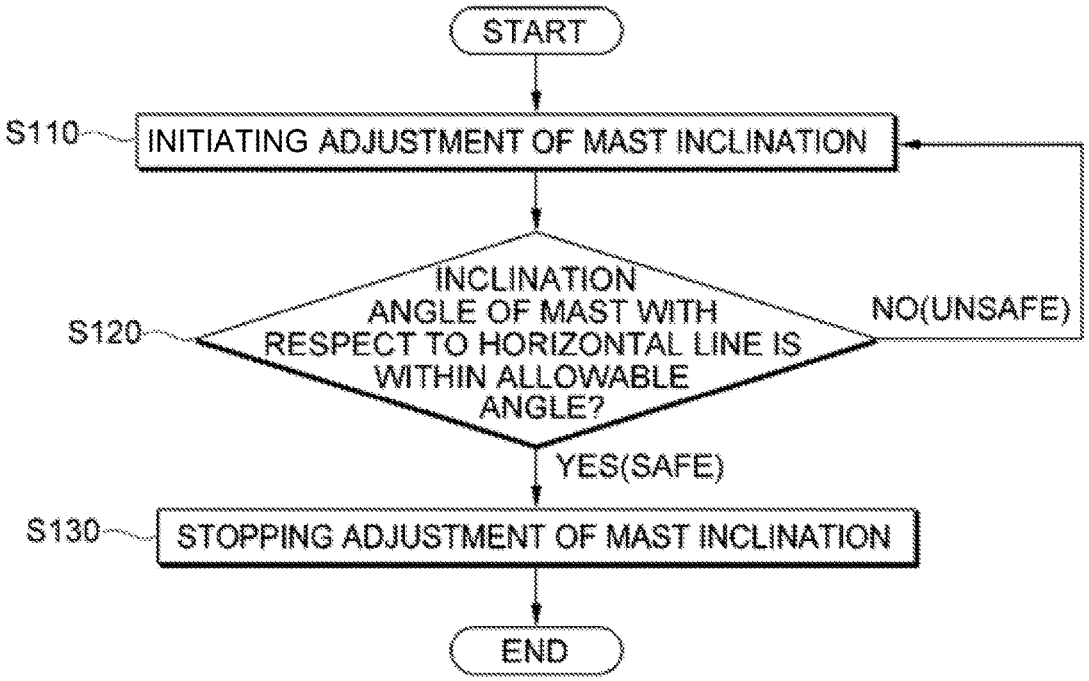
[FIG. 5]

FORKLIFT INCLUDING AN APPARATUS FOR CONTROLLING THE FORKLIFT

TECHNICAL FIELD

The present disclosure relates to an apparatus and a method for controlling a forklift, and more particularly, to an apparatus and a method for controlling a forklift, which adjust an inclination angle of a mast according to a weight of a cargo load and a travelling speed, thereby preventing the cargo from falling.

BACKGROUND

In general, a forklift is used for transporting a cargo. More particularly, the forklift is loaded with a cargo on a fork, moves, and unloads the cargo to transport the cargo.

In the meantime, the forklift receives power from a power source and operates a hydraulic system, and the hydraulic system generates hydraulic pressure. The forklift is operated by hydraulic pressure or an engine and a motor, or raises up a fork by hydraulic pressure. Further, the fork may be provided in a mast, and the mast may be inclined forward and backward in the forklift. The aforementioned power source may be an internal combustion engine or an electric motor.

On the other hand, a cargo is mounted on a pallet, and the fork of the forklift is fitted into the pallet. When the fork is raised by an operation of the forklift, the cargo is raised, and when the forklift travels, the cargo is transported.

A travelling path, along which the forklift is to travel, may be a flat road or a slope. The slope road may be understood as an uphill road or a downhill road according to a travelling direction of the forklift.

When the forklift travels, the forklift travels in a state where the mast is tilted backward so as to prevent the cargo from falling. The meaning of the tilted backward is that the mast is tilted toward a main body of the forklift. Similarly, the meaning of the forward tilt is that the mast is tilted in a front direction.

In the related art, an operator controls a degree of forward tilt or a degree of backward tilt of the mast by recognizing a travelling path. Accordingly, the operator needs to appropriately control an inclination angle of the mast at an appropriate time at which the forklift enters or exits from a slope.

On the other hand, a cargo is disposed at a front side of the forklift, so that when the forklift travels in the front direction, the travelling path may be invisible by the cargo. Accordingly, there is a problem in that it is difficult to obtain information on the travelling path, that is, it is difficult to secure a view.

Accordingly, in the related art, it is difficult to adjust an inclination angle of the mast of the forklift at an appropriate time, and further, an operator may not know a degree of adjustment of the inclination angle of the mast. Particularly, the appropriate adjustment of the inclination angle of the mast is considerably varied according to a skill level of an operator, and there may be a case where an unskillful operator incorrectly sets an inclination angle of the mast. Further, there may be a case where an operator completely irrelevantly controls an inclination of the mast in an incorrect direction due to an incorrect determination, and in this case, there is a concern in that the cargo may fall.

On the other hand, in a state where an inclination of the mast is incorrectly set, the cargo may move in a backward direction or a forward direction by inertia when a travelling speed of the forklift is decreased or increased. In any case, the movement of the cargo is in an unstable state, thereby being dangerous. Particularly, when the movement direction of the cargo is the forward direction, a falling danger of the cargo is increased. Here, the forward direction means a direction away from a main body of the forklift.

Further, even when the forklift travels in a state where the mast is excessively tilted backward, the cargo may move according to a change in a speed of the forklift, such that it is required that the inclination of the mast is appropriately maintained.

Korean Patent Application Laid-Open No. 10-2012-0069816 (Jun. 29, 2012) describes further background teachings.

SUMMARY

A technical object to be achieved in the present disclosure is to provide an apparatus and a method for controlling a forklift, which adjust an inclination angle of a mast in real time, or decrease a travelling speed of the forklift or stop the forklift in order to prevent a cargo from falling by overloading or speeding during the travelling in a state where the cargo is loaded.

A technical object to be achieved in the present disclosure is not limited to the aforementioned technical objects, and another not-mentioned technical object will be obviously understood from the description below by those with ordinary skill in the art to which the present disclosure pertains.

In order to achieve the technical object, an apparatus for controlling a forklift according to an exemplary embodiment of the present disclosure includes: a setting component 100 which sets reference weight of a cargo load; an input component 200 into which weight of an actual cargo load is detected and input, and a cargo movement direction, in which the actual cargo slides and moves on a fork 30, is input; a determining component 300 which determines whether the cargo is overloaded by comparing the weight of the actual cargo load with a reference weight of the cargo load, and determines a backward/forward cargo movement direction; and a processing component 400 which gives a control command to a vehicle control unit (VCU) or a hydraulic system so that an inclination of a mast is adjusted when the determining component 300 determines that the cargo is overloaded and determines that the movement direction of the cargo is a direction away from a main body of the forklift.

The apparatus may further include a brake or a brake control component which is installed in a travelling system of the forklift 10 and brakes the forklift 10, in which the setting component 100 may further set a reference travelling speed, a current travelling speed of the forklift may be further input into the input component 200, the determining component 300 may further determine whether the forklift speeds by comparing the current travelling speed with the reference travelling speed, and when the determining component 300 may determine that the forklift speeds and the movement direction of the cargo is determined as the direction away from the main body of the forklift, the processing component 400 may give a control command so that the brake or the brake control component is controlled to decrease the travelling speed of the forklift or stop the forklift.

The apparatus may further include a power train or a power train control component which is installed in a power train system of the forklift 10 to transmit power to the traveling system, in which the setting component 100 may further set a reference travelling speed, a current travelling speed of the forklift may be further input into the input component 200, the determining component 300 may further determine whether the forklift speeds by comparing the current travelling speed with the reference travelling speed, and when the determining component 300 determines that the forklift speeds and the movement direction of the cargo is determined as the direction away from the main body of the forklift, the processing component 400 may give a control command so that the power train or the power train control component is operated to control an output size of the power.

The apparatus may further include a brake or a brake control component which is installed in a travelling system of the forklift 10 and brakes the forklift 10; and a power train or a power train control component which is installed in a power train system of the forklift 10 to transmit power to the traveling system, in which the setting component 100 may further set a reference travelling speed, a current travelling speed of the forklift may be further input into the input component 200, the determining component 300 may further determine whether the forklift speeds by comparing the current travelling speed with the reference travelling speed, and when the determining component 300 determines that the forklift speeds and the movement direction of the cargo is determined as the direction away from the main body of the forklift, the processing component 400 may give a control command so that the brake or the brake control component is controlled to decrease the travelling speed of the forklift or stop the forklift, or give a control command so that the power train or the power train control component is controlled to control an output size of the power.

The setting component 100 may further set an allowable angle of a reference inclination of the mast, a current inclination of the mast with respect to a horizontal line may be further input into the input component 200, and the processing component 400 may give a control command to the VCU or the hydraulic system so that the current inclination of the mast is maintained within the allowable angle of the reference inclination angle of the mast.

A sensor 40 may be provided to a fork vertical part 32 of the fork 30, the sensor 40 may measure a distance value to the actual cargo loaded on the fork 30, and when the distance value is increased, it may be determined that the movement direction of the cargo is a direction away from a main body of the forklift.

A pair of forks 30 may be disposed side by side, a bracket 34 may be further formed at the fork vertical part 32 of any one fork 30 between the pair of forks 30, and the sensor 40 may be provided at the bracket 34.

In order to achieve the technical object, a method of controlling a forklift according to another exemplary embodiment of the present disclosure includes: a first step s10, in which reference weight of a cargo load is set; a second step s20, in which weight of an actual cargo load is input, and a direction, in which the actual cargo slides on a fork 30, is input; a third step s30, in which it is determined whether the cargo is overloaded according to whether the weight of the actual cargo load exceeds the reference weight of the cargo load; a fourth step s40, in which it is determined whether the direction, in which the actual cargo slides on the fork 30, is a forward direction; and a sixth step s60, in which when the cargo is overloaded, and the direction, in which the actual cargo slides on the fork 30, is the forward direction, a control command is given to a vehicle control unit (VCU) or a hydraulic system so that an inclination of a mast is adjusted.

In the first step s10, a reference travelling speed may be further set, in the second step s20, a current travelling speed of the forklift may be further input, the method may further include a fifth step s50, in which the current travelling speed is compared with the reference travelling speed, and it is further determined whether the forklift speeds, and when the cargo is overloaded, the forklift speeds, and the direction, in which the actual cargo slides on the fork 30, is the forward direction, a control command may be given to a VCU or a hydraulic system so that an inclination of a mast is adjusted, and a control command may be given so that a travelling speed of the forklift is decreased or the forklift is stopped.

In the first step s10, a reference travelling speed may be further set, in the second step s20, a current travelling speed of the forklift may be further input, the method may further include a fifth step s50, in which the current travelling speed is compared with the reference travelling speed, and it is further determined whether the forklift speeds, and when the cargo is overloaded, the forklift speeds, and the direction, in which the actual cargo slides on the fork 30, is the forward direction, a control command may be given to a VCU or a hydraulic system so that an inclination of a mast is adjusted, and a control command may be given so that a power train or a power train control component is operated, and thus an output size of the power may be controlled.

Other detailed matters of the exemplary embodiments are included in the detailed description and the drawings.

The apparatus and the method for controlling the forklift according to the exemplary embodiment of the present disclosure may adjust an inclination of a mast or decrease a travelling speed of the forklift so as to prevent a cargo from falling when the cargo is overloaded or the forklift speeds in a state where the cargo is loaded on the fork, and may decelerate the forklift or stop the forklift when falling danger of the cargo is not decreased, thereby preventing the cargo from falling.

BRIEF DESCRIPTION OF DRAWINGS

FIGS. 1 and 2 are diagrams of a configuration of a forklift according to an exemplary embodiment of the present disclosure.

FIG. 3 is a diagram of an apparatus for controlling a forklift according to an exemplary embodiment of the present disclosure such as the forklift of FIGS. 1 and 2.

FIG. 4 is a flowchart of a method for controlling the forklift according to the exemplary embodiment of the present disclosure.

FIG. 5 is a diagram of an example of controlling an inclination of a mast in the method for controlling the forklift according to the exemplary embodiment of the present disclosure.

DESCRIPTION OF REFERENCE NUMERALS

10: Forklift
20: Mast
22: Tilting actuator
30: Fork
32: Fork vertical part
34: Bracket
40: Sensor
50: Pallet
60: Cargo

DETAILED DESCRIPTION

Advantages and characteristics of the present disclosure, and a method of achieving the advantages and characteristics will be clear with reference to an exemplary embodiment to be described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping to understand the present disclosure, and the present disclosure may be variously modified to be carried out differently from the exemplary embodiment described herein. In the following description of the present disclosure, a detailed description and a detailed illustration of publicly known functions or constituent elements incorporated herein will be omitted when it is determined that the detailed description may unnecessarily make the subject matter of the present disclosure unclear. Further, the accompanying drawings are not illustrated according to an actual scale, but sizes of some constituent elements may be exaggerated to help understand the present disclosure.

Further, the terms used in the description are defined considering the functions of the present disclosure and may vary depending on the intention or usual practice of a manufacturer. Therefore, the definitions should be made based on the entire contents of the present specification.

Like reference numerals indicate like elements throughout the specification.

First, a configuration of a forklift, and an apparatus and a method for controlling the forklift will be described with reference to FIGS. 1 to 3. FIGS. 1 and 2 are diagrams of a configuration of a forklift according to an exemplary embodiment of the present disclosure. FIG. 3 is a diagram of an apparatus 1000 for controlling a forklift, such as the forklift of FIGS. 1 and 2, according to an exemplary embodiment of the present disclosure.

A forklift 10 is mounted with a hydraulic system. The hydraulic system receives power from a power source. The power source may be an engine or an electric motor.

Further, a mast 20 is installed at a front side of the forklift 10, and a fork 30 is provided in the mast 20.

A cargo 60 or a pallet 50 may be mounted to the fork 30. Universally, the fork 30 enters and exits from the pallet 50. That is, when the cargo 60 is mounted on the pallet 50, a weight of the cargo 60 is applied to the fork 30.

In the meantime, the fork 30 is elevated by an operation of the mast 20. The mast 20 may be provided with a step according to a specification of the forklift 10, and when a height of the step is high, the mast 20 may raise up the cargo 60 to a higher position.

A tilting actuator 22 is disposed between the forklift 10 and the mast 20. The tilting actuator 22 may be operated by hydraulic pressure, and the hydraulic pressure is provided from the hydraulic system. That is, the tilting actuator 22 adjusts an inclination of the mast 20 by tilting forward or backward the mast 20 according to the control of a mast solenoid valve provided in the hydraulic system.

The mast solenoid valve controls a flow rate and a flow direction, and the mast 20 may accurately control a speed, at which the mast 20 is tilted, and a degree of inclination angle by controlling the mast solenoid valve.

Further, a power train or a power train control component is provided in the forklift 10 according to the exemplary embodiment of the present disclosure. The power train or the power train control component transfers power output from the engine or a driving motor to a travelling system or the hydraulic system.

That is, when the power train or the power train control component is controlled by a control command output from a processing component 400 of the control apparatus 1000, a size of power may be controlled, and for example, when a size of power is controlled to be decreased, the size of power is decreased, so that a travelling speed may be decreased.

Further, a brake or a brake control component 14 is provided in a travelling system of the forklift 10 according to the exemplary embodiment of the present disclosure. The brake or the brake control component 14 applies braking to the travelling of the forklift 10.

The electronic brake or the brake control component may be applied, so that it is possible to more precisely control desired braking force. That is, when the brake or the brake control component is operated by a control command output from the processing component 400, a travelling speed of the forklift 10 may be decreased regardless of an intention of a driver.

In the meantime, the forklift 10 according to the exemplary embodiment of the present disclosure may sequentially control or simultaneously control the power train or the power train control component and the brake or the brake control component. Accordingly, it is possible to more stably and smoothly decrease a travelling speed of the forklift 10.

That is, when a travelling speed of the forklift 10 is decreased by any type, falling danger of the cargo 60 is decreased by the amount of decrease in the travelling speed.

With reference to FIG. 3, the apparatus 1000 for controlling the forklift according to the exemplary embodiment of the present disclosure includes a setting component 100, an input component 200, a determining component 300, and a processing component 400.

The setting component 100 sets reference weight of a cargo load. The reference weight of the cargo load may be set to, for example, 100 kgf. The reference weight of the cargo load may be pre-set by a manufacturing company according to performance of a forklift, and may be set again according to an intention of an operator.

Further, the setting component 100 may further set a reference travelling speed. The reference travelling speed may be set to, for example, 3 km/h. The reference travelling speed may be pre-set by a manufacturing company according to performance of a forklift, and may be set again according to an intention of an operator.

Further, the setting component 100 may further set an allowable angle of a reference inclination angle of the mast. The allowable angle may be set to, for example, 2°. The reference mast inclination angle may be pre-set by a manufacturing company according to performance of a forklift, and may be set again according to an intention of an operator. In the meantime, an inclination of the mast and an inclination of the fork may be treated as the same data. The reason is that when the mast 20 is tilted, the fork 30 is tilted together. Further, an angle of the fork 30 with respect to the mast 20 is uniform. Accordingly, when an operator knows an inclination of the mask, the operator may naturally easily know an inclination of the fork. Hereinafter, an inclination of the mast and an inclination of the fork are expressed as a mast inclination.

A weight of an actual cargo load is detected and input into the input component 200. Further, a cargo movement direction, in which the cargo actually slides and moves in the fork 30, is input into the input component 200. Further, a current traveling speed of the forklift 10 may be input into the input component 200.

A weight of the actual cargo load may be obtained by mounting a weight sensor to the fork 30, or may also be estimated by pressure applied to a lift cylinder of the mast 20. That is, information on weight of a cargo load is obtained by using a well-known technology, and a more detailed description thereof will be omitted.

The cargo movement direction may be recognized by a sensor 40 provided in a fork vertical part 32 of the fork 30 as illustrated in FIGS. 1 and 2. This will be additionally described below. When the cargo 60 is loaded on the fork 30, the sensor 40 measures a distance to the cargo 60, and the measured initial distance value is input into the input component 200.

The sensor 40 continuously measures a distance value to the actual cargo loaded on the fork 30 in real time. That is, when the distance value is increased, it may be determined that the cargo movement direction is a direction away from a main body of the forklift.

The cargo movement direction will be described in more detail below. After the forklift 10 initiates to travel, the cargo 60 may slide and move on the fork 30. A case where the cargo 60 slides includes a case where the cargo 60 slides because the fork 30 is not horizontal or because of inertia. A direction, in which the cargo slides, is any one of a forward direction or an inward direction. The forward direction is a direction, in which the cargo 60 becomes away from the main body of the forklift 10, and the inward direction is a direction, in which the cargo 60 becomes close to the main body of the forklift 10.

When the cargo 60 moves in the forward direction, a danger of cargo falling is especially further increased, so that it is necessary to very importantly respond to the movement of the cargo 60 in the forward direction. Further, even though the movement direction of the cargo 60 is the inward direction, carefulness is required when a movement displacement of the cargo 60 is rapidly changed.

In order to prevent the cargo 60 from falling, there are a method of adjusting an inclination of the mast 20, and a method of controlling a travelling speed of the forklift 10 to be decreased or controlling the forklift 10 to be stopped.

Particularly, when the cargo 60 is overloaded or the forklift speeds, the forklift may be more dangerous.

On the other hand, a pair of forks 30 is disposed side by side, and as illustrated in FIG. 2, a bracket 34 may be further formed on the fork vertical part 32 of any one fork 30 between the pair of forks 30. The sensor 40 may be provided at the bracket 34. Accordingly, the sensor 40 may more accurately measure a distance to the cargo 60. The reason is that the cargo may not always exist at a predetermined position, but there are more cases in which the cargo is located at around a center point of both forks. On the other hand, the sensor 40 is disposed between the fork and the fork, that is, at an inner side, so that the sensor 40 may be more safely protected from external impact.

The determining component 300 determines whether the cargo is overloaded by comparing a value input into the input component 200, that is, a weight of the actual cargo load, with the reference weight of the cargo load. For example, the reference weight of the cargo load is set to 100 kgf, but when the weight of the actual cargo load exceeds 100 kgf, the determining component 300 determines that the cargo is overloaded.

Further, the determining component 300 determines a backward/forward movement direction of the cargo. Further, the determining component 300 may determine whether the forklift speeds by comparing a current travelling speed with the reference travelling speed. For example, the reference travelling speed is set to 3 km/h, but when the actual travelling speed is higher than 3 km/h, the determining component 300 may determine that the forklift speeds.

When the determining component 300 determines that the forklift speeds, and the movement direction of the cargo is determined as the direction away from the main body of the forklift, the processing component 400 gives a control command so that an inclination of the mast is adjusted. More particularly, the processing component 400 gives a control command so as to control a vehicle control unit (VCU) or the hydraulic system. Accordingly, the mast 20 is adjusted to be tilted backward, thereby preventing the cargo 60 from falling.

In contrast, when the movement direction of the cargo is determined as the direction close to the main body of the forklift, and a displacement detected by the sensor 40 is sharply changed or a displacement amount is large, the mast 20 may also be adjusted to be tilted forward.

Further, when the determining component 300 determines that the forklift speeds and the movement direction of the cargo is determined as the direction away from the main body of the forklift, the processing component 400 may give a control command so that the brake or the brake control component is controlled to decrease the travelling speed of the forklift or stop the forklift. Accordingly, the travelling speed of the forklift 10 is decreased or the forklift 10 is stopped, thereby preventing the cargo 60 from falling.

Further, when the determining component 300 determines that the forklift speeds and the movement direction of the cargo is determined as the direction away from the main body of the forklift, the processing component 400 may give a control command so that the power train or the power train control component is operated to control an output size of the power. Accordingly, the travelling speed of the forklift 10 is decreased or the forklift 10 is stopped, thereby preventing the cargo 60 from falling.

Further, when the determining component 300 determines that the forklift speeds and the movement direction of the cargo is determined as the direction away from the main body of the forklift, the processing component 400 may give a control command so that the brake or the brake control component is controlled to decrease the travelling speed of the forklift or stop the forklift, and may give a control command so that the power train or the power train control component is operated to control an output size of the power. Accordingly, the travelling speed of the forklift 10 is decreased or the forklift 10 is stopped, thereby more effectively preventing the cargo 60 from falling.

Further, the processing component 400 may give a control command to the VCU or the hydraulic system so that the current inclination of the mast is maintained within an allowable angle of the reference inclination angle of the mast. The inclination of the mast may be obtained by adding and subtracting an inclination of the mast with respect to the vehicle to and from an inclination of the vehicle with respect to the horizontal line. The inclination of the mast with respect to the vehicle may be obtained by an angle detecting sensor. The inclination of the vehicle may be obtained by using a gyro sensor, an acceleration sensor, and the like. Accordingly, it is possible to prevent the cargo 60 from falling by maintaining the mast within the allowable angle by tilting the mast forward or backward when the forklift is located on a slope.

Further, the processing component 400 may output a warning according to a degree of falling danger of the cargo 60. The warning may output a warning sound so that an operator may audibly recognize the warning or may output a warning message on a dashboard so that an operator may visually recognize the warning.

Hereinafter, a method for controlling a forklift according to an exemplary embodiment of the present disclosure will be described with reference to FIGS. 4 and 5. FIG. 4 is a flowchart for describing the method for controlling the forklift according to the exemplary embodiment of the present disclosure. FIG. 5 is a diagram for describing an example of controlling an inclination of a mast in the method for controlling the forklift according to the exemplary embodiment of the present disclosure.

Hereinafter, the method for controlling the forklift according to the exemplary embodiment of the present disclosure will be described for each operation.

First step s10: The first step is a step, in which a reference value for each data is set. For example, the first step is a step, in which a reference weight of a cargo load is set. Further, in the first step, an allowable angle of a reference inclination angle of the mast may be set. Further, in the first step, a reference travelling speed of a travelling speed of the forklift may be set. The first step s10 may be preset by a manufacturing company of a corresponding forklift, and may also be updated by an intention of a user.

Second step s20: The second step is a step, in which a weight of an actual cargo load is input, and a direction, in which the actual cargo slides on the fork 30, is input. Further, in the second step s20, a current inclination angle of the mast may be input, and a current travelling speed may be input.

Third step s30: The third step is a step, in which whether the cargo is overloaded is determined according to whether the weight of the actual cargo load exceeds the reference weight of the cargo load.

Fourth step s40: The fourth step is a step, in which it is determined whether a direction, in which the actual cargo slides on the fork 30, is a forward direction.

Fifth step s50: The fifth step is a step, in which when it is determined that the cargo is overloaded, and it is determined that the direction, in which the actual cargo slides on the fork 30, is the forward direction, it is determined whether the forklift speeds. When it is determined that the forklift speeds in the fifth step, a control command may be given to the VCU or the hydraulic system so that the inclination of the mast is adjusted (s60), and a control command may be given so that the travelling speed of the forklift is decreased or the forklift is stopped (s70). Then, the method returns to the second step s20.

Sixth step s60: The sixth step is a step, in which when it is determined that the cargo is overloaded, and it is determined that the direction, in which the actual cargo slides on the fork 30, is the forward direction, a control command is given to the VCU or the hydraulic system so that the inclination of the mast is adjusted (s60). Further, the sixth step may be performed after the fifth step. Then, the method returns to the second step s20.

Further, when it is determined that the cargo is overloaded, it is determined that the forklift speeds, and it is determined that the direction, in which the actual cargo slides on the fork 30, is the forward direction during the process up to the fifth step s50, a control command is given to the VCU or the hydraulic system so that the inclination of the mast is adjusted (s60), and a control command may be given so that the power train or the power train control component is operated, and thus an output size of the power is controlled.

On the other hand, when it is determined that the cargo is not overloaded in the third step s30, the method may proceed to the fourth-1 step s41. The fourth-1 step s41 is a step, in which it is determined whether a direction, in which the actual cargo slides on the fork 30, is the forward direction. When a movement direction of the cargo is an inward direction in the fourth-1 step, the method returns to the second step s20. However, when the movement direction of the cargo is the forward direction, the method proceeds to the seventh step s70 to decrease the travelling speed of the forklift or stop the travelling of the forklift. Then, the method returns to the second step s20.

On the other hand, when it is determined that the forklift does not speed in the fifth step s50, the method directly proceeds to the seventh step s70 without passing through the process of adjusting the inclination of the mast to decrease the travelling speed of the forklift or stop the travelling of the forklift. Then, the method returns to the second step s20. That is, the proceeding to the fifth step s50 means that the cargo 60 moves in the forward direction, so that in order to decrease falling danger of the cargo 60, the travelling speed of the forklift is decreased.

On the other hand, when it is determined that the direction, in which the actual cargo slides on the fork 30, is the inward direction in the fourth step s40, the method may proceed to the fifth-1 step s50. The fifth-1 step s50 is a step of determining whether the forklift speeds. When the forklift does not speed, falling danger of the cargo 60 is low, so that the method returns to the fourth step s40.

When it is determined that the forklift speeds in the fifth-1 step s51, the method may proceed to the sixth-1 step. The sixth-1 s61 step is a step of adjusting an inclination of the mast. That is, falling danger of the cargo 60 due to speeding exists, so that the falling danger of the cargo 60 is further decreased by adjusting the inclination of the mast. Then, the method may proceed to the seventh-1 step s71. In the seventh-1 step s71, the forklift continuously travels at a current speed, and the falling danger of the cargo 60 is low, so that the method returns to the fourth step s40.

Hereinafter, the method of adjusting the inclination of the mast will be described with reference to FIG. 5. When the adjustment of the inclination of the mast is initiated (S110), the tilt actuator 22 is operated by the VCU or the hydraulic system mounted in the forklift.

When the tilt actuator 22 is operated, the inclination of the mast 20 is adjusted, and it is determined whether the inclination angle of the mast is within an allowable angle (s120).

When the inclination angle of the mast is not included within the allowable angle, the tilt actuator 22 is continuously operated. Whether the tilt actuator 22 is extended or contracted may be determined based on the current inclination angle of the mast 20 and the inclined direction of the mast 20. For example, when the mast 20 is tilted forward, the mast 20 is adjusted to be tilted backward as a matter of course.

Then, when the inclination angle of the mast is included within the allowable angle, the operation of the tilt actuator 22 is stopped (s130). Accordingly, the adjustment of the inclination of the mast is completed.

The apparatus and the method for controlling the forklift 10 according to the exemplary embodiment of the present disclosure may automatically control a fork/mast inclination and decrease a travelling speed of the forklift 10 even though an operator is unskilled in controlling the forklift, thereby decreasing falling danger of the cargo 60.

The apparatus and the method for controlling the forklift 10 according to the exemplary embodiment of the present disclosure enable an operator to set a reference weight of a cargo load, a reference travelling speed, and an allowable angle of a reference inclination of the mast, so that it is possible to differently set a case where danger of damaging the cargo 60 of the operation target is low and a case where danger of damaging the cargo 60 of the operation target is high. Accordingly, it is possible to improve an operation speed by setting a setting value with a margin or improve operation stability by sensitively setting the setting value.

The exemplary embodiments of the present disclosure have been described with reference to the accompanying drawings, but those skilled in the art will understand that the present disclosure may be implemented in another specific form without changing the technical spirit or essential feature thereof.

Accordingly, it will be understood that the aforementioned exemplary embodiments are described for illustration in all aspects and are not limited, and it should be interpreted that the scope of the present disclosure shall be represented by the claims to be described below, and all of the changes or modified forms induced from the meaning and the scope of the claims, and an equivalent concept thereof are included in the scope of the present disclosure.

The apparatus and the method for controlling the forklift according to the present disclosure may be used for preventing a cargo from falling by controlling an inclination angle of the mast to be adjusted or controlling a travelling speed to be decreased or the forklift to be stopped when the cargo is overloaded over the set weight or the forklift speeds over a set speed.

The invention claimed is:

1. An apparatus for controlling a forklift, comprising:

a controller including a setting component which sets a reference weight of a cargo load, wherein the reference weight of the cargo load is pre-set by a manufacturing company according to performance of the forklift, or set according to an intention of an operator;

an input component which receives a weight of an actual cargo load and a cargo movement direction, wherein the weight of the actual cargo load is detected by mounting a weight sensor to a fork or is estimated by pressure applied to a lift cylinder of a mast, and the cargo movement direction is recognized by a sensor which is attached to a vertical portion of the fork and measures a distance value to the actual cargo loaded on the fork;

a determining component which determines whether the cargo is overloaded by comparing the weight of the actual cargo load with the reference weight of the cargo load, and determines that the movement direction of the cargo is a direction away from a main body of the forklift;

a processing component which transmits a control command to a vehicle control unit (VCU) or a hydraulic system so that an inclination of the mast is adjusted when the determining component determines that the cargo is overloaded and determines that the movement direction of the cargo is a direction away from a main body of the forklift;

a brake and a brake control unit which is installed in a travelling system of the forklift and brakes the forklift; and a power train and a power train control unit which is installed in a power train system of the forklift to transmit power to the traveling system, wherein the setting component further sets a reference travelling speed, a current travelling speed of the forklift is further input into the input component, the determining component further determines whether the forklift is moving at a speed above the reference travelling speed by comparing the current travelling speed with the reference travelling speed, and when the determining component determines that the forklift is moving at a speed above the reference travelling speed and the movement direction of the cargo is determined as the direction away from the main body of the forklift, the processing component transmits a control command so that the brake and the brake control component is controlled to decrease the travelling speed of the forklift or stop the forklift, or transmits a control command so that the power train and the power train control component is operated to control an output size of the power.

2. The apparatus of claim 1, wherein the forklift is factory set with a maximum stable angle of a reference inclination of the mast, a current inclination of the mast with respect to a horizontal line is further input into the input component, and the processing component gives a control command to the VCU or the hydraulic system so that the current inclination of the mast is maintained within the allowable angle of the reference inclination angle of the mast.

3. The apparatus of claim 1, wherein when the distance value is increased, it is determined that the movement direction of the cargo is a direction away from the main body of the forklift.

4. The apparatus of claim 3, wherein a pair of forks is substantially parallel, a bracket is mounted on the portion of either fork and the sensor is attached to the fork at the bracket.

5. A method of controlling a forklift, comprising:

setting a reference weight of a cargo load and a reference travelling speed, wherein the reference weight of the cargo load is pre-set by a manufacturing company according to performance of the forklift, or set according to an intention of an operator;

receiving a weight of an actual cargo load, a cargo movement direction, and a current travelling speed of the forklift, wherein the weight of the actual cargo load is detected by mounting a weight sensor to a fork or is estimated by pressure applied to a lift cylinder of a mast, and the cargo movement direction is recognized by a sensor which is attached to a vertical portion of the fork and measures a distance value to the actual cargo loaded on the fork;

determining that the cargo is overloaded according to whether the weight of the actual cargo load exceeds the reference weight of the cargo load;

determining whether the direction is a direction away from a main body of the forklift, transmitting a control command to a vehicle control unit (VCU) or a hydraulic system so that an inclination of a mast is adjusted when the cargo is overloaded and the cargo movement direction, is a forward direction;

determining whether the forklift is moving at a speed above the reference travelling speed by comparing the current travelling speed with the reference travelling speed, and transmitting a control command so that the brake and a brake control component is controlled to decrease the travelling speed of the forklift or stop the forklift, or a control command so that the power train and the power train control component is operated to control an output size of the power, when the forklift is moving at a speed and the movement direction of the cargo is determined as the direction away from the main body of the forklift.

* * * * *